United States Patent [19]

Liu et al.

[11] Patent Number: 5,062,813

[45] Date of Patent: Nov. 5, 1991

[54] STRUCTURE OF RECEPTACLE TERMINAL MATERIAL STRIP

[75] Inventors: Yun-Yu Liu, Taipei; Juinn-Horng Lu, Yunlin Hsien, both of Taiwan

[73] Assignee: Pan-International Industrial Corp., Taipei Hsien, Taiwan

[21] Appl. No.: 574,090

[22] Filed: Aug. 29, 1990

[51] Int. Cl.[5] ..... H01R 11/22

[52] U.S. Cl. ..... 439/857; 439/516

[58] Field of Search ..... 439/733, 851, 852, 856, 439/857, 861, 862, 78, 79, 444, 516, 843

[56] References Cited

U.S. PATENT DOCUMENTS

| | | | |
|---|---|---|---|
| 3,058,091 | 10/1962 | Henschen | 439/851 |
| 4,446,505 | 5/1984 | Long et al. | 439/516 |
| 4,697,864 | 10/1987 | Hayes et al. | 439/444 |
| 4,795,379 | 1/1989 | Sasaki et al. | 439/856 |

FOREIGN PATENT DOCUMENTS

| | | | |
|---|---|---|---|
| 1909416 | 11/1970 | Fed. Rep. of Germany | 439/851 |
| 6411701 | 4/1966 | Netherlands | 439/851 |
| 1275596 | 12/1986 | U.S.S.R. | 439/857 |

*Primary Examiner*—Larry I. Schwartz
*Assistant Examiner*—Hien D. Vu
*Attorney, Agent, or Firm*—Fleit, Jacobson, Cohn, Price, Holman & Stern

[57] ABSTRACT

A receptacle terminal material strip of which each terminal has integrally a front plug terminal retaining portion having a folded frame formed by bending the front end of the terminal backward with two opposite spring strips relatively obliquely projecting forward inward for holding a plug terminal and convenient for receiving electroplating process; an intermediate fastening portion having two wing projections at two opposite sides for fastening in a terminal seat in the rubber core of a receptacle; and a rear electrical connection portion having a substantially U-shaped cross section with a plurality of indentations made thereon for breaking according desired length. The terminals under processing of the receptacle terminal material strip are respectively connected with one another at two locations so that precise size can be achieved through automatic manufacturing process.

3 Claims, 4 Drawing Sheets

STRUCTURE OF RECEPTACLE TERMINAL MATERIAL STRIP

BACKGROUND OF THE INVENTION

1. Field of the Invention

The present invention relates to receptacle terminals and more particularly to a receptacle terminal which is formed by a bending process from a terminal material strip in which the pitch between terminals can be arranged according to the pitch between terminal seats of the receptacle for convenient installation. The invention is suitable for high quality electroplating process. Through a two-part connection, the terminals of a terminal material strip can be precisely processed.

2. Description of the Prior Art

FIGS. 1 and 2 illustrate a type of receptacle terminal to which the present invention pertains, in which the front end (A) which is for connection thereto of a plug terminal is formed by bending the material inward from two opposite sides (a). With this arrangement, the pitch between the terminals of a terminal material strip (B) is limited to a certain range, i.e. the pitch can not be reduced to a desired range. As a consequence, the process in fastening terminals in a receptacle becomes more difficult and expensive. Because the plug terminal connecting end (A) is formed by bending the two opposite sides (a) of the material inward, during an electroplating process of a terminal material strip (B) the substantially vertically disposed opposite sides (a) of the material may interfere with the circulation of plating solution to affect electroplating quality. Further, because the plug terminal connecting ends (A) are respectively connected to the terminal material strip (B) through a electrical connecting end portion (C) each, i.e. each terminal is connected to the terminal material strip at a point, high precision terminals become more difficult to obtain from a terminal material strip.

SUMMARY OF THE INVENTION

The present invention has been devised substantially to eliminate the afore-said problems. It is one object of the present invention to provide a receptacle terminal which is suitable for mass production.

It is another object of the present invention to provide a receptacle terminal material strip for producing receptacle terminals, which is suitable for high quality electroplating process.

It is still another object of the present invention to provide a receptacle terminal material strip for producing receptacle terminals, which is convenient for accurately controlling the pitch between terminals according to the specification of a receptacle in which it is to install.

According to a first aspect of the present invention, a receptacle terminal material strip comprises a plurality of terminals having each a front plug terminal retaining portion, an intermediate fastening portion and a rear end electrical connection portion. The front plug terminal retaining portion has a folded frame formed by bending the front end of the terminal backward so as to minimize space required between terminals. Therefore, the pitch between the terminals of the receptacle terminal strip material can be arranged according to the specification of the receptacle in which it is to install.

According to a second aspect of the present invention, a receptacle terminal material strip comprises a plurality of terminals having each a front plug terminal retaining portion, an intermediate fastening portion and a rear end electrical connection portion. The front plug terminal retaining portion has a folded frame formed by bending the front end of the terminal backward with two opposite spring strips relatively obliquely projecting forward and inward for holding a plug terminal and convenient for passing therethrough of plating solution during an electroplating process so that high quality of electroplating result can be achieved.

According to a third aspect of the present invention, a receptacle terminal material strip comprises a plurality of terminals having each a front plug terminal retaining portion, an intermediate fastening portion and a rear end electrical connection portion, wherein the terminals are respectively connected with one another, by the material of the receptacle terminal material strip itself, both at the electrical connecting portion as well as at a part between the plug terminal retaining portion and the fastening portion so as to facilitate high speed automatic manufacturing.

DETAILED DESCRIPTION OF THE PREFERRED EMBODIMENT

Figure 1:
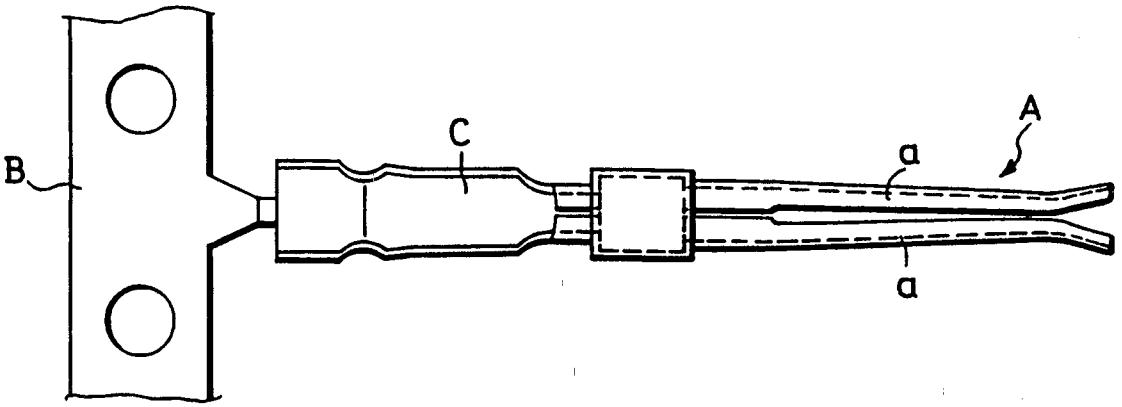
FIG. 1 (PRIOR ART)
FIG. 1 is a front view of a receptacle terminal according to the prior art.
Figure 2:
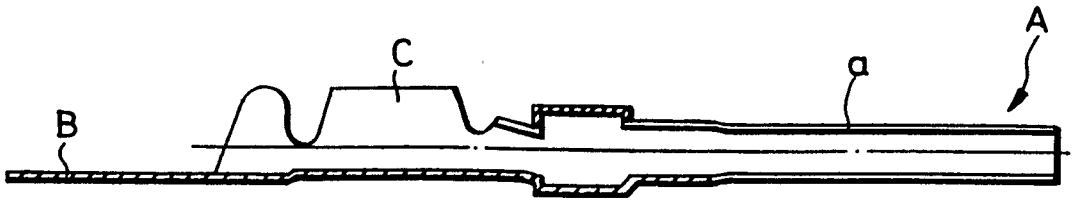
FIG. 2 (PRIOR ART)
FIG. 2 is a longitudinal sectional view of the receptacle terminal of FIG. 1.
Figure 3:
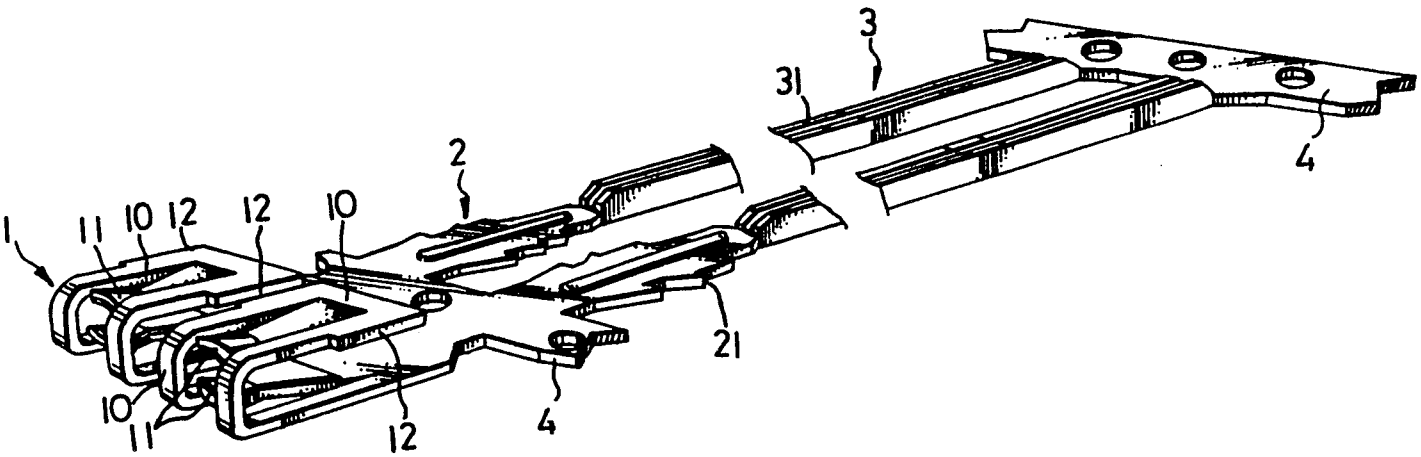
FIG. 3 is a perspective schematic drawing of a receptacle terminal material strip according to the present invention.
Figure 4:
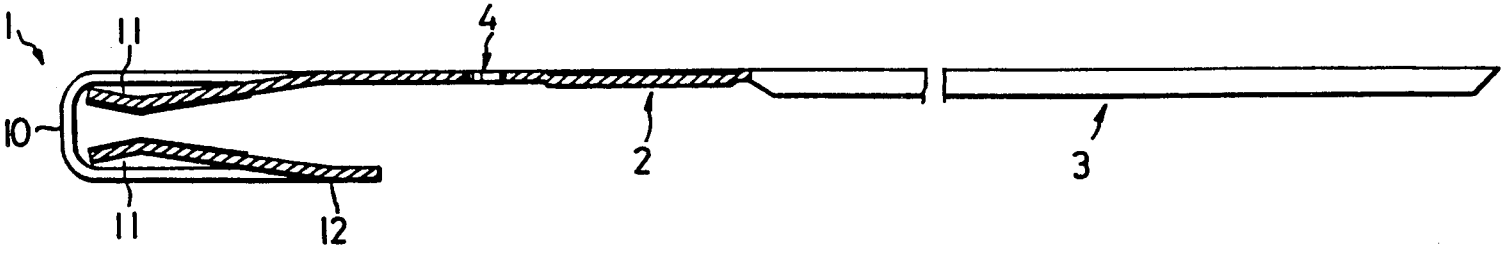
FIG. 4 is a longitudinal sectional view of preferred embodiment of the present invention.
Figure 5:
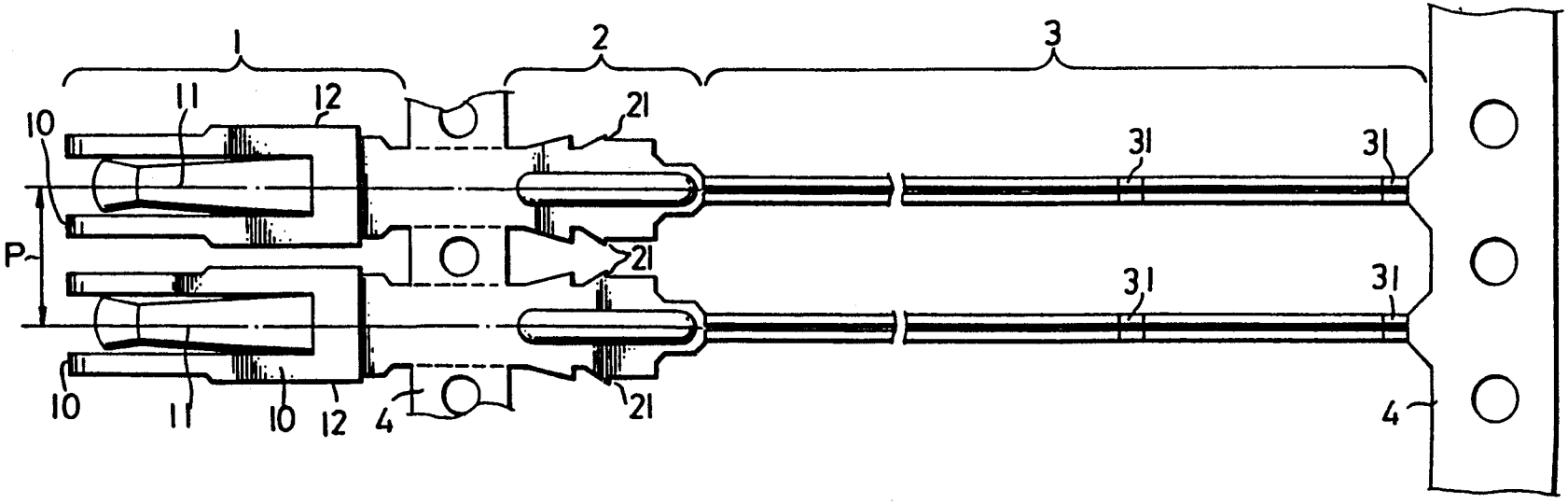
FIG. 5 is a front view of a receptacle terminal material strip according to the present invention.

Referring to FIG. 3, a receptacle terminal of the present invention is generally integrally comprised of a front plug terminal retaining portion 1 for connection thereto of a plug terminal, an intermediate fastening portion 2 for the positioning of the terminal in a rubber core of a receptacle, and a rear end connecting portion 3 for electrical connection. The front plug terminal retaining portion 1 comprises a folded frame 10 formed by bending the front end of the terminal backward with two opposite spring strips 11 relatively obliquely projecting forward and inward (see FIG. 4) for holding an inserted pin or the like. The intermediate fastening portion 2 comprises two wing projections 21 at two opposite sides. The rear end connecting portion 3 is an elongated rod having a substantially U-shaped cross section, which is shape formed by bending the front plug terminal retaining portion 1 back and forth. Since no additional material needs to be left at the two opposite sides of each terminal for bending, pitch P between two terminals can be minimized. As shown in FIG. 5 which is a front view of a terminal material strip according to the present invention, the pitch P between terminals is arranged according to the pitch specification of the terminal seats of regular receptacles for convenient installation.

According to the present invention satisfactory electroplating quality can be conveniently achieved. Because there is no side material in the front plug terminal retaining portion 1 of each terminal, a terminal material strip of the present invention can be conveniently thoroughly electroplated. Once a terminal material strip of the present invention is dipped in an electroplating bath, plating solution will immediately uniformly cover the two opposite spring strips 11 of each terminal so that high electroplating quality can be achieved. Further, in a terminal material strip, the terminals under processing are respectively connected with one another through material 4 at each rear end connecting portion 3 as well as both at the part between the front plug terminal retaining portion 1 and the intermediate fastening portion 2 (see particularly FIG. 5). This arrangement stabilizes the position of the terminals under processing in a terminal material strip so that high precision (pitch control between terminals) can be achieved under high speed automatic receptacle terminal manufacturing process.

Figure 6:
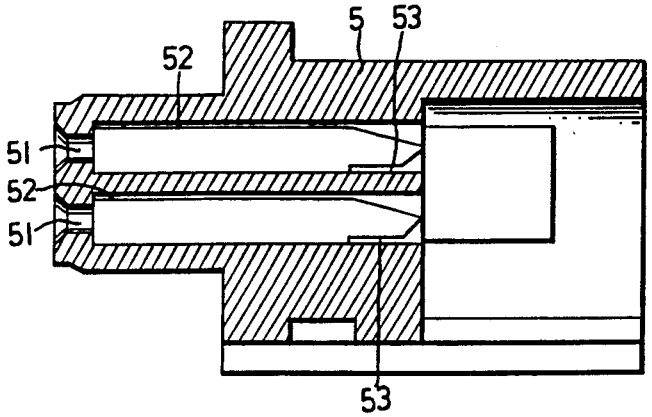
FIG. 6 is a sectional view illustrating the structure of a terminal seat in the rubber core of a receptacle according to the present invention.
Figure 7:
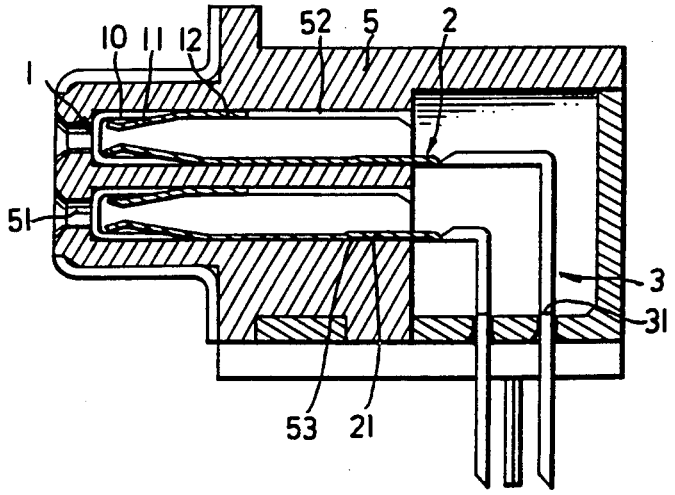
FIG. 7 is a sectional assembly view of a receptacle according to the present invention.

Referring to FIG. 6, when a terminal of the present invention is inserted in each terminal seat 51 on the rubber core 5 of a receptacle, its wing projections 21 are engaged in the groove 53 inside the terminal seat 51, its front plug terminal retaining portion 1 is disposed at the front end of the terminal seat 51, and its two opposite spring strips 11 are disposed against each other (see FIG. 7) for holding a plug terminal for connection electrically. Further, each terminal has a plurality of indentations 31 on its connecting portion 3 so that it can be broken at a desired length according to the structure of a receptacle 5.

Figure 8:
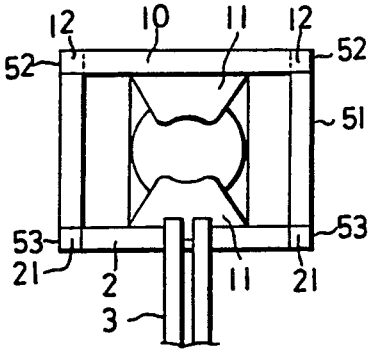
FIG. 8 is back sectional view of a receptacle according to the present invention.

According to the present invention, each terminal seat 51 of the rubber core 5 of a receptacle comprises two grooves 52, 53 each respectively made at two opposite sides at an upper location as well as at a lower location (see FIG. 6). When a terminal is fastened in each terminal seat 51, the wider part 12 (see FIG. 5) of the frame 10 of the front plug terminal retaining portion 1 is inserted in the upper grooves 52 and the wing projections 21 of the intermediate fastening portion 2 are fastened in the lower grooves 53 (see FIG. 7). Thus, the plug terminal retaining portion 1 of the terminal becomes stably fastened in a receptacle (see FIG. 8) and good electrical connection can be achieved.

We claim:

1. A receptacle terminal material strip, comprising a plurality of terminals for fastening in terminal seats of a rubber core of a receptacle, characterized in that:

said terminals comprise each integrally:

a plug terminal retaining portion at the front, comprising a folded frame having upper and lower frame portions formed by bending the front end of the terminal backward each frame portion comprising side arms and a spring strip between the side arms, the spring strip relatively obliquely projecting forward and inward for holding a plug terminal, the upper and lower side arms being substantially parallel and the frame being open at each side between the upper and lower side arms;

a fastening portion at the middle, having two wing projections at two opposite sides for fastening said terminal in either of said terminal seats in said rubber core; and an electrical connection portion at the rear end, being an elongated rod having a substantially U-shaped cross section and a plurality of indentations for breaking according desired length.

2. The receptacle terminal material strip of claim 1, wherein said terminals are respectively connected with one another, by material of the receptacle terminal material strip itself, at said electrical connecting portion as well as at a part between said plug terminal retaining portion and said fastening portion.

3. The receptacle terminal material strip of claim 1, wherein said terminal seats of said rubber core comprises two grooves at two opposite sides at an upper location for fastening therein of the wider end of said frame of said terminal retaining portion, and another two grooves at two opposite sides at a lower location for fastening therein of the wing projections of said fastening portion.

* * * * *